United States Patent [19]

Scheurecker et al.

[11] Patent Number: 4,480,680

[45] Date of Patent: Nov. 6, 1984

[54] BOW-TYPE CONTINUOUS CASTING PLANT FOR STRANDS

[75] Inventors: Werner Scheurecker, Linz; Walter Antonitsch, Kematen, both of Austria

[73] Assignee: Voest-Alpine Aktiengesellschaft, Linz, Austria

[21] Appl. No.: 520,749

[22] Filed: Aug. 5, 1983

Related U.S. Application Data

[63] Continuation of Ser. No. 182,763, Aug. 29, 1980, abandoned.

[30] Foreign Application Priority Data

Oct. 1, 1979 [AT] Austria ..... 6396/79

[51] Int. Cl.[3] ..... B22D 11/12

[52] U.S. Cl. ..... 164/442; 164/448

[58] Field of Search ..... 164/442, 448, 484; 193/35 R; 226/189

[56] References Cited

U.S. PATENT DOCUMENTS

| | | | |
|---|---|---|---|
| 3,648,504 | 3/1972 | Schoffmann | 72/164 |
| 3,753,461 | 8/1973 | Gallucci et al. | 164/448 |
| 3,893,503 | 7/1975 | Eibl | 164/282 |
| 3,994,334 | 11/1976 | Schrewe | 164/448 |
| 4,007,822 | 2/1977 | Scheurecker | 193/35 R |
| 4,022,268 | 5/1977 | Biricz | 164/448 |
| 4,076,069 | 2/1978 | Scheinecker et al. | 164/448 |
| 4,197,904 | 4/1980 | Streubel et al. | 164/448 |
| 4,223,715 | 9/1980 | Streubel | 164/448 X |

FOREIGN PATENT DOCUMENTS

| | | |
|---|---|---|
| 342802 | 4/1978 | Austria . |
| 1289955 | 2/1969 | Fed. Rep. of Germany . |
| 1458201 | 6/1971 | Fed. Rep. of Germany . |
| 2133144 | 9/1973 | Fed. Rep. of Germany . |
| 2264330 | 7/1974 | Fed. Rep. of Germany . |

*Primary Examiner*—Nicholas P. Godici
*Assistant Examiner*—J. Reed Batten, Jr.
*Attorney, Agent, or Firm*—Brumbaugh, Graves, Donohue & Raymond

[57] ABSTRACT

A bow-type continuous casting plant includes a strand bending arrangement arranged below the mould, and a circular-arc guide for the strand following thereupon. The circular-arc guide has oppositely arranged supporting roller ways, and the bending arrangement includes two oppositely arranged bow-structure parts carrying bending and supporting rollers each, and being supported on each other. The distance of the supporting-roller ways of the circular-arc guide is variable in accordance with the strand cross section to be adjusted. One of the bow-structure parts of the bending arrangement is provided with exchangeable roller carriers detachably fastened to it and adapted to different strand cross-sectional formats with their dimensions.

9 Claims, 5 Drawing Figures

BOW-TYPE CONTINUOUS CASTING PLANT FOR STRANDS

BACKGROUND OF THE INVENTION

This application is a continuation of application Ser. No. 182,763, filed on Aug. 29, 1980 and now abandoned.

The invention relates to a bow-type continuous casting plant comprising a strand bending arrangement arranged below the mould, and a circular-arc guide for the strand following thereupon and including oppositely arranged supporting roller ways, wherein the bending arrangement includes two oppositely arranged bow-structure parts carrying bending and supporting rollers each and being supported on each other, the distance of the supporting roller ways of the circular-arc guide being variable in accordance with a strand cross section to be adjusted.

In a continuous casting plant of this type, the adjustment of the distance of the oppositely arranged roller ways usually is carried out by a parallel displacement of one of the roller ways. If, for instance, the roller ways of the bending zone and the circular-arc guide, located on the bow inner side one after the other, are displaced inwardly, i.e., towards the center of curvature, for the purpose of increasing the strand thickness, the rollers that are arranged at the ends of these roller ways directed to each other will approach each other. In order to prevent these rollers from colliding, it is necessary—with the roller ways adjusted to the smallest thickness possible—to provide an unreasonably great roller distance between the neighbouring end rollers of the bending arrangement and the circular-arc guide. If this is unacceptable due to, for example, undue bulging of the strand skin, it becomes necessary to displace one of the roller ways, in addition to the parallel displacement of the two adjacent roller ways, also in the axial direction of the strand guide way, so that the distance of the neighbouring end rollers of these roller ways remains approximately the same for different strand thicknesses. This is a cumbersome operation to carry out, and necessitates constructional elements that are provided especially for this purpose, rendering the plant more expensive, complicating resetting and constituting an additional source of errors of the continuous casting plant. In particular with a large displacement range, as is required in modern continuous casting plants for slabs and for circular-arc guides designed in one piece—these extend almost over a quarter circle—the above-mentioned difficulties are particularly eminent.

SUMMARY OF THE INVENTION

The invention aims at avoiding these disadvantages and difficulties, and has as its object to provide a bow-type continuous casting plant of the initially-defined kind, in which a change of the distance of the oppositely arranged roller ways is possible in a simple manner such that the distance of the end rollers of neighbouring roller ways of the bending arrangement and the circular-arc guide remains approximately the same.

This object is achieved according to the invention in that one of the bow-structure parts of the bending arrangement comprises roller carriers that are detachably fastened to the same, exchangeable and adapted to different strand cross-sectional formats with their dimensions, in particular with their lengths.

A suitable embodiment is characterized in that the roller carriers are fastened to a bow-structure inner part of the bending arrangement.

Advantageously, the distance of the oppositely arranged bending and supporting rollers of the bending arrangement is variable by an exchange of the roller carriers adapted, with their thickness, to different strand cross-sectional formats. In this case, a change of the casting thickness is particularly simple to carry out, since no adjusting manipulations whatsoever have to be carried out at the bending arrangement. The adjustment of the roller distance is effected by an exchange of the roller carriers alone. It merely is necessary to detach the roller carriers at the bending arrangement or to fasten them, respectively. Thereby, also measuring works can be omitted at the roller ways of the bending arrangement.

It is, however, also possible and in some cases even suitable to change the distance between the inner part of the bow structure and an outer part of the bow structure, of the bending arrangement, by a parallel displacement of one of the bow-structure parts.

Therein, it is suitable that the bow-structure inner part is fastened to the bow-structure outer part by means of pins along which one of the bow-structure parts is displaceably guided and on which this part is supported relative to the second bow-structure part by means of shims.

According to a preferred embodiment, the roller carriers are designed in one piece over the length of the bending arrangement, the installation and the removal of the roller carriers thus being effected particularly quickly.

For a precise setting and adjustment of the roller carriers, the roller carriers suitably are supported relative to the bow-structure parts by means of exchangeable inserts.

For a simple handling of the roller carriers the latter, in a plant with bending and supporting rollers supported on two or more spots—an arcuate longitudinal carrier being provided at each supporting spot—are connected so as to form a commonly installable and removable construction unit.

BRIEF DESCRIPTION OF THE DRAWINGS

The invention will now be explained in more detail by way of accompanying drawings, wherein.

DESCRIPTION OF EXEMPLARY EMBODIMENTS

Figure 1:
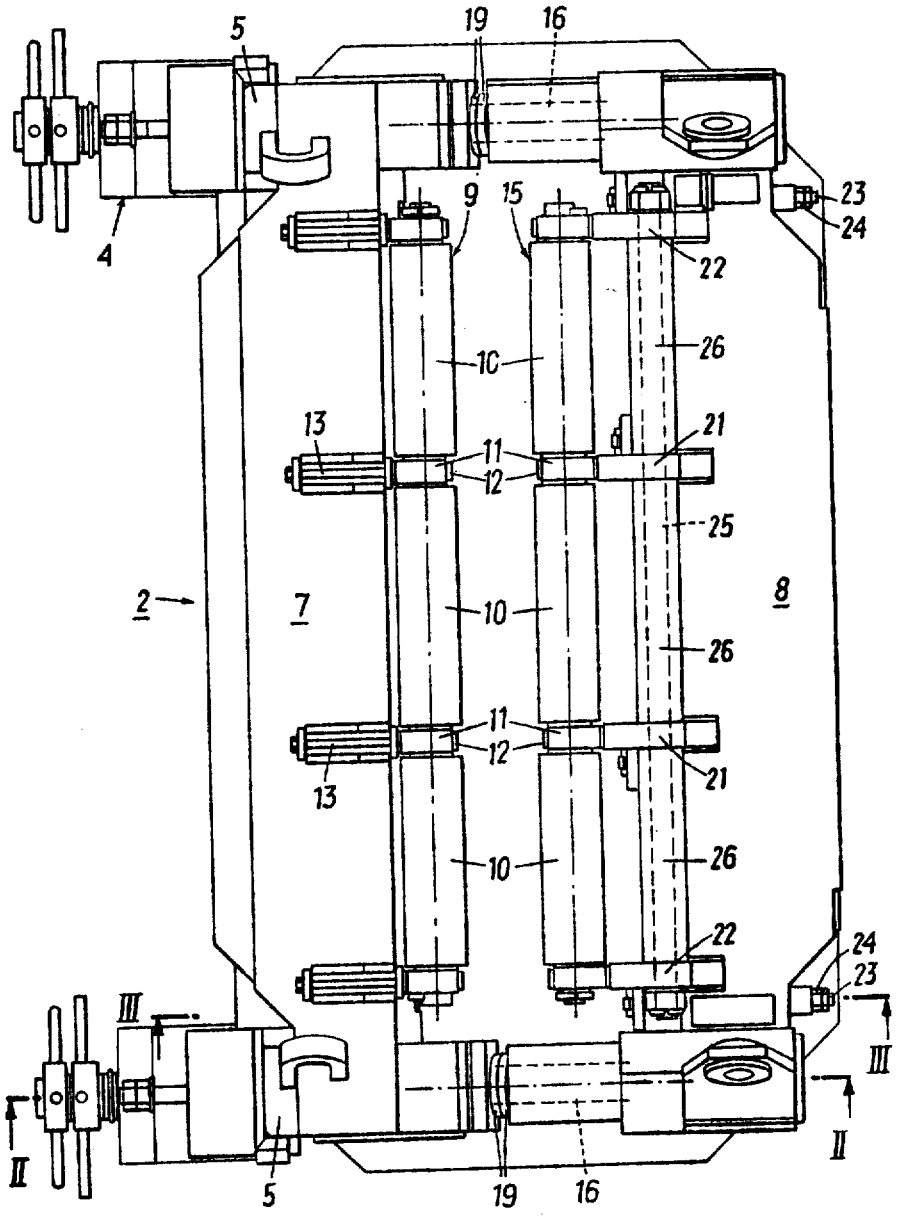
FIG. 1 is a view of a bending arrangement from above in the direction of the longitudinal axis of the strand.
Figure 2:
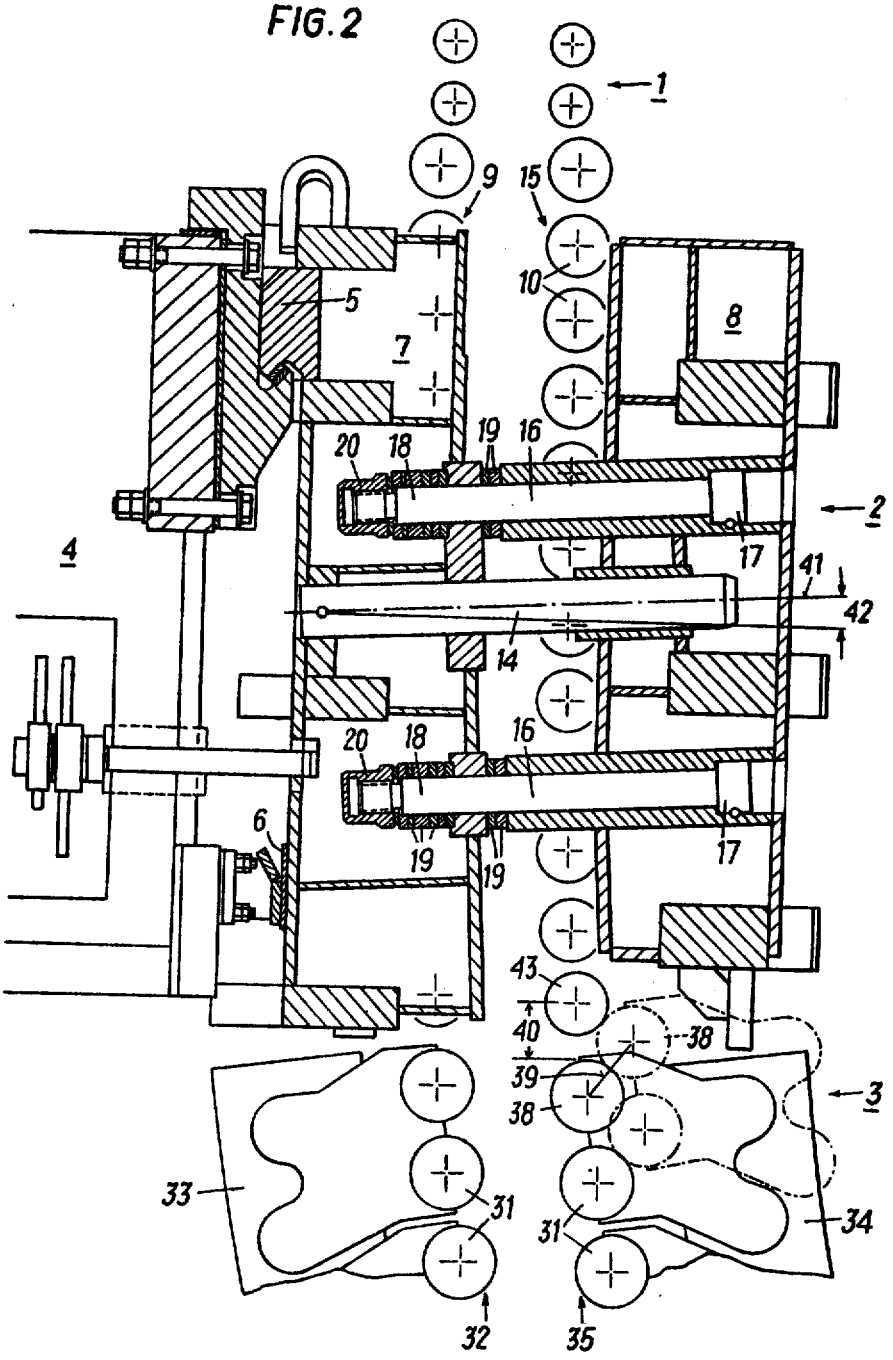
FIG. 2 is a section along line II—II of FIG. 1.

With reference to FIGS. 1 and 2, below a continuous casting mould (not illustrated), a short, vertically directed guiding path 1 for the strand is arranged, upon which a bending arrangement 2 follows. Below the bending arrangement, a circular-arc guide 3 is provided, in which the strand is guided from an almost vertical direction into an almost horizontal direction.

The bending arrangement 2, which is suspended on a stationary supporting structure 4 by means of a nose-shaped hook 5 provided on the upper end of the bending arrangement, and which, at its lower end, leans against this supporting structure 4 via a seat 6, is assembled of two oppositely arranged, box-shaped structure parts 7, 8. On the bow-structure outer part 7, which is arranged on the bow outer side of the strand guide, the bending and supporting rollers 10 forming the bow outer-side roller way 9 are fastened, wherein two bearing brackets 11 of neighbouring rollers 10 are each braced against the bow-structure outer part 7 by a crosshead 12 by means of a tension bolt 13. On the bow-structure outer part 7 guiding pins 14 are each arranged laterally of the ends of the rollers 10, on which the bow-structure inner part 8 carrying the bending and supporting rollers 10 forming the bow inner-side roller way 15 is displaceably guided. For fixing the bow-structure inner part 8 on the bow-structure outer part 7, tension pins 16 are provided laterally of the ends of the rollers 10, which tension pins 16 are fastened to the bow-structure inner part 8 with their heads 17 and, with their other ends 18, are supported on the bow-structure outer part 7 on interposing exchangeable shims 19 and secured by a cap nut 20.

The distance of the bow-structure inner part 8 from the bow-structure outer part 7 and thus the distance of the bow inner-side roller way 15 from the bow outer-side roller way 9, of the bending arrangement 2, can be varied by a rearrangement of the shims 19.

The bending and supporting rollers 10 of the bow inner-side roller way 15 are not directly fastened to the structure part, as this is the case with the bow-structure outer part 7, but they are fastened on roller carriers 21, 22 (FIG. 3) extending as one piece over the length of the bending arrangement 2, one crosshead 12 each bracing two bearing brackets 11 of neighbouring rollers 10 against the roller carriers 21, 22 by means of a tension bolt 13.

As can be seen from FIG. 1, the rollers 10 are designed in three parts, the rollers of the roller way 15 being supported, at each partition site and at their ends, on one roller carrier 21, 22 each. The roller carriers 21 and 22 are fastened to the bow-structure inner part by screw bolts 23 and nuts 24. All the roller carriers 21, 22 are assembled into one construction unit by means of pins 25 onto which distance sleeves 26 are slipped. The roller carriers furthermore include approximately vertically directed supporting surfaces 27 as well as one horizontal supporting surface 28 each, with which they rest against cross beams 29 arranged on the bow-structure inner part 8 on interposing inserts 30 fastened to the roller carriers 21, 22.

The circular-arc guide 3 following upon the bending arrangement 2 comprises longitudinal carriers 33 for supporting the bow outer-side roller way 32 formed of supporting rollers 31, which longitudinal carriers 33 are connected, by means of tension rods (not illustrated), with longitudinal carriers 34 arranged on the bow inner side and carrying the supporting rollers 31 of the bow innerside roller way 35.

Figure 3:
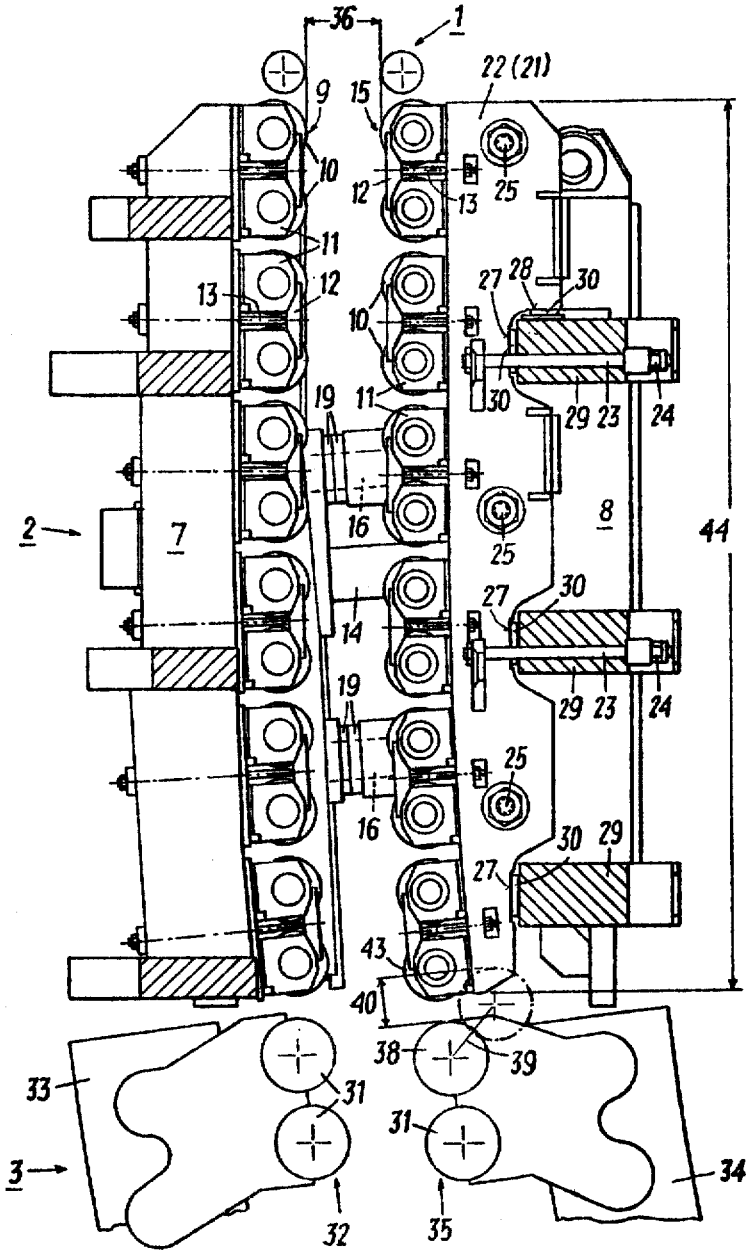
FIG. 3 is a section along line III—III of FIG. 1.
Figure 4:
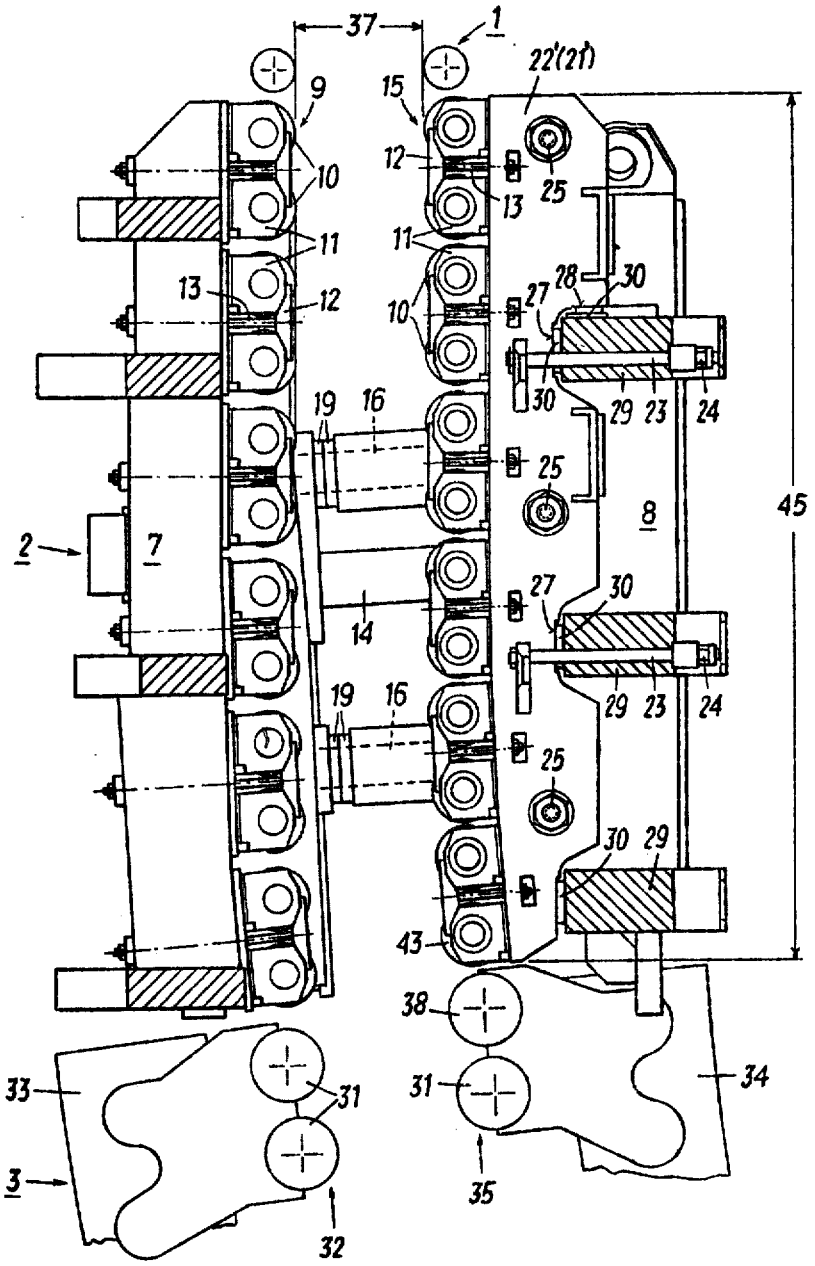
FIG. 4 shows, in an illustration analogous to FIG. 3, a plant adjusted to the greatest casting thickness possible.

When changing the distance of the two roller ways 32, 35 of the circular-arc guide 3, from the smallest roller way distance 36 (FIG. 3) to the greatest distance 37 (FIG. 4) to be adjustable in this plant, the upper end roller 38 of the circular-arc guide located at the bow inner side moves from the position represented in FIGS. 2 and 3 by full lines into the position illustrated in FIGS. 2 and 3 by dot-and-dash lines, which is displaced from the position drawn in full lines in the direction of a straight line 39 inclined by about 45° to the horizontal. The inclination for this displacement direction is about 45° because the circular-arc guide extends approximately from the vertical to almost the horizontal, and because the longitudinal deviation, which is denoted by 40 in FIGS. 2 and 3, i.e., the deviation in the longitudinal direction of the roller ways, is to be approximately equal on both ends of the circular-arc guide.

The displacement direction 41 of the bow-structure inner part relative to the bow structure outer part is also inclined to the horizontal at a certain angle 42. As can be seen from FIG. 2, the lower end roller 43 of the bow-structure inner part 8 would get into contact with the upper end roller 38 of the circular-arc guide 3 when displacing the bow-structure inner part 8 of the bending arrangement 2 to the greatest distance 37 possible; the displacement will then be impeded. In order to prevent this, the roller carriers 21, 22, which have a length 44 with the narrowest distance 36 adjusted, are exchanged for roller carriers 21', 22' with a shortened length 45. This is achieved by releasing the nuts 24 of the screw bolts 23, lifting the roller carriers 21, 22 out and inserting the new roller carriers 21', 22', and subsequent tightening of the nuts 24 (cf. FIG. 4).

The range between the smallest distance 36 and the greatest distance 37 of the roller ways suitably is subdivided into several sub-ranges, separate roller carriers 21, 22; 21', 22' etc. being provided for each sub-range. Within these sub-ranges the roller carriers that are each provided for this sub-range may be used for any other distance of the roller ways 9, 15, since an approach or a divergence of the end rollers 38, 43 of the bow-structure inner part 8 and of the circular-arc guide 3 is permissible up to a certain measure.

Simultaneously with the exchange of the roller carriers 21, 22, the change of the distance of the bow-structure inner part 8 to the bow-structure outer part 7 is effected by a rearrangement of the shims 19.

Figure 5:
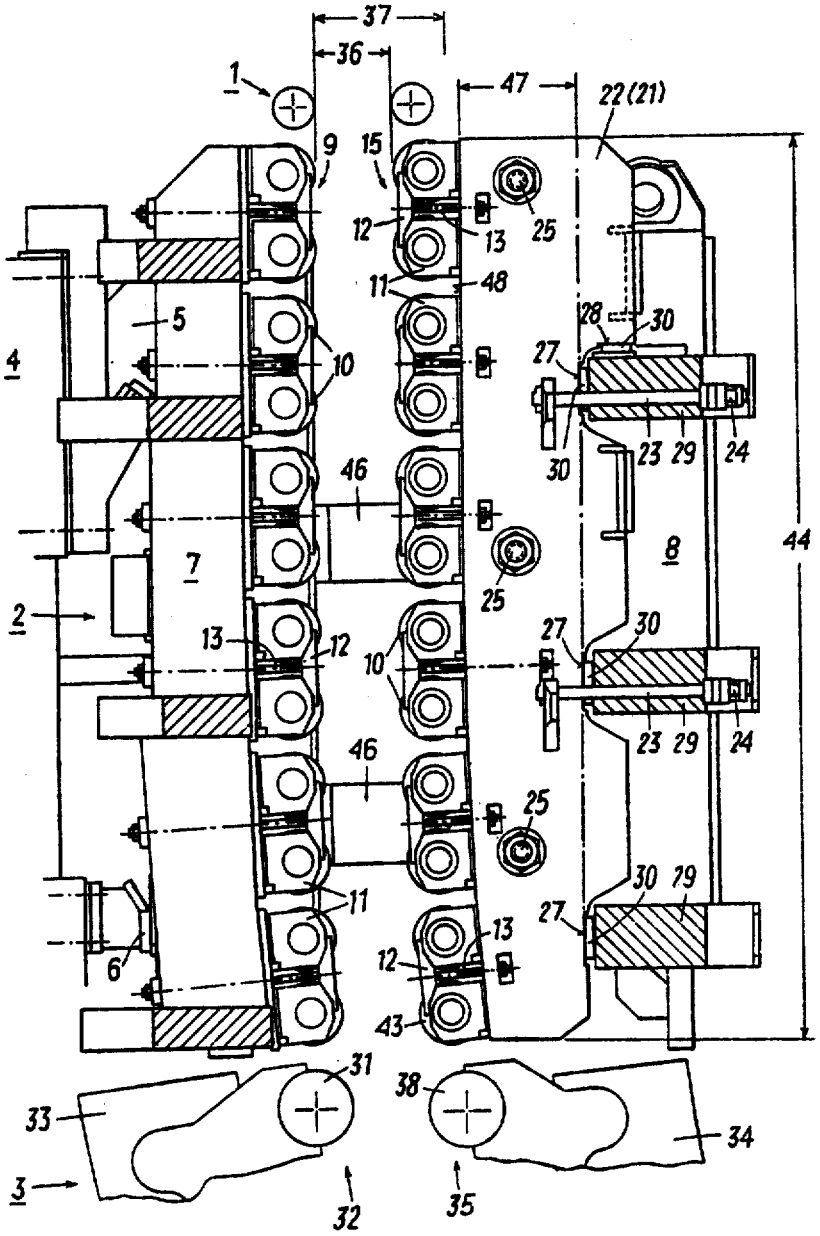
FIG. 5 is a further embodiment of the plant according to the invention in an illustration analogous to FIG. 3.

In the embodiment illustrated in FIG. 5 the bow-structure inner part is fixed to the bow-structure outer part by means of two connecting pins 46. According to this embodiment, the roller carriers 21, 22 are again exchanged when resetting the plant from one casting thickness to another, the roller carriers, however, not only having a different length 44 and 45, but also a different thickness 47 determining the roller distance. This means that also the distance from the approximately vertically directed supporting surfaces 27 of the roller carriers 21, 22 to the resting surfaces 48 of the bearing brackets 11 also differs. In this embodiment, the resetting of the plant from one strand thickness to another is particularly simple, since the bow-structure inner part 8 need not be displaced relative to the bow-structure outer part 7. Thereby, the number of the manipulations to be carried out at the bending arrangement 2 is reduced. In this embodiment the range between the smallest distance 36 and the greatest distance 37 of the roller ways 9 and 15 also is subdivided in sub-ranges, roller carriers having a certain length and thickness being provided for each sub-range. Within each sub-range the roller way distance can be varied by exchanging the inserts 30 provided between the approximately vertical supporting surfaces 27 and the cross beams 29.

Both in the embodiment illustrated in FIGS. 1 to 4 and in the embodiment illustrated in FIG. 5, the bow outerside roller ways 9, 32 are rigidly arranged, i.e., they are not displaced when adjusting a roller gap corresponding to the thickness of the strand. This is, however, merely a preferred embodiment. It would also be possible that the bow inner-side roller ways 15, 35 are undisplaceable and the bow outer-side roller ways are adjustable to a desired strand thickness.

What we claim is:

1. In a bow-type continuous casting plant for strands of the type including a mould, a bending arrangement for the strand arranged below said mould, and a circular-arc guide for the strand following said bending arrangement, said circular-arc guide having a first roller way and a second roller way arranged opposite each other for accomodating supporting rollers, the spacing between said first and second roller ways of said circular-arc guide being variable in accordance with the strand cross-section by parallel displacement of at least one of said roller ways along a radius of curvature of said arc, said bending arrangement being comprised of oppositely disposed bow-structure parts supported on each other, each of said bow-structure parts carrying a set of bending and supporting rollers, the sets of bending and supporting rollers defining a path for said strand leading into said circular-arc guide roller-ways, the improvement wherein one of said bow-structure parts with its respective set of bending and supporting rollers is fixed on a supporting structure and the other of said bow-structure parts is displaceable toward and away from said fixed bow-structure part, and wherein a plurality of interchangeable roller carriers for the rollers is provided for said displaceable bow-structure part, each of said roller carriers carrying a set of bending and supporting rollers and being of a different predetermined length, in the direction of said strand, corresponding to a different strand cross-section format and spacing of the roller ways of said circular-arc guide.

one of said roller carriers with its set of bending and supporting rollers being detachably fastened to the displaceable bow-structure part at a time.

2. A bow-type continuous casting plant as set forth in claim 1, wherein the bow-structure parts of said bending arrangement comprise a bow-structure inner part and a bow-structure outer part, the roller carriers being fastened to said bow-structure inner part.

3. A bow-type continuous casting plant as set forth in claim 1, wherein the distance of said oppositely arranged bending and supporting rollers of said bending arrangement is variable by exchanging said roller carriers adapted to different strand cross-sectional formats in terms of thickness.

4. A bow-type continuous casting plant as set forth in claim 1, wherein the bow-structure parts of said bending arrangement comprise a bow-structure inner part and a bow-structure outer part, the distance between said bow-structure inner part and said bow-structure outer part being variable by parallel displacement of one of said bow-structure parts.

5. A bow-type continuous casting plant as set forth in claim 4, further comprising pins for fastening said bow-structure inner part to said bow-structure outer part, one of said bow-structure parts being displaceably guided along said pins, and shims for supporting said one of said bow-structure parts displaceably guided along said pins relative to the other of said bow-structure parts.

6. A bow-type continuous casting plant as set forth in claim 1, wherein said exchangeable roller carriers are designed in one piece over the length of said bending arrangement.

7. A bow-type continuous casting plant as set forth in claim 1, further comprising exchangeable inserts for supporting said exchangeable roller carriers relative to said bow-structure parts.

8. A bow-type continuous casting plant as set forth in claim 1, wherein said bending and supporting rollers of said bending arrangement are journaled on at least two spots and one roller carrier is provided on each of said at least two spots so as to provide adjacently arranged roller carriers, said adjacently arranged roller carriers being connected to form a commonly removable and installable construction unit.

9. A bow-type continuous casting plant as set forth in claim 8, further comprising pins penetrating said roller carriers for connecting said roller carriers to form a commonly removable and installable construction unit.

* * * * *